US010306968B2

(12) United States Patent
Flockenhagen

(10) Patent No.: US 10,306,968 B2
(45) Date of Patent: Jun. 4, 2019

(54) CONTAINER FOR ACCOMMODATING A FLOWABLE FLUID

(71) Applicant: WEENER PLASTIK GMBH, Weener (DE)

(72) Inventor: Gerhold Flockenhagen, Weener-Krichborgum (DE)

(73) Assignee: Weener Plastik GmbH, Weener (DE)

( * ) Notice: Subject to any disclaimer, the term of this patent is extended or adjusted under 35 U.S.C. 154(b) by 111 days.

(21) Appl. No.: 15/512,238

(22) PCT Filed: Feb. 16, 2015

(86) PCT No.: PCT/EP2015/000340

§ 371 (c)(1),
(2) Date: Mar. 17, 2017

(87) PCT Pub. No.: WO2016/045756

PCT Pub. Date: Mar. 31, 2016

(65) Prior Publication Data

US 2017/0290405 A1 Oct. 12, 2017

(30) Foreign Application Priority Data

Sep. 23, 2014 (DJ) ..... 20 2014 007 748 U

(51) Int. Cl.
*A45D 34/04* (2006.01)
*A45D 40/26* (2006.01)

(52) U.S. Cl.
CPC ..... *A45D 34/041* (2013.01); *A45D 40/261* (2013.01)

(58) Field of Classification Search
CPC .... A45D 34/041; A45D 40/261; B05C 17/02; B05C 17/0227; B05C 17/025; B05C 17/0247
See application file for complete search history.

(56) References Cited

U.S. PATENT DOCUMENTS 4,221,495 A * 9/1980 Braun ..... A45D 34/041 401/213
7,311,462 B2 * 12/2007 Kervoalen ..... A45D 34/041 401/209

FOREIGN PATENT DOCUMENTS

DE 20 2013 000328 U1 1/2013
EP 1 673 998 A1 6/2006
(Continued)

OTHER PUBLICATIONS

Official Action with machine English Translation for Russia Patent Application No. 2017107964, dated Mar. 20, 2018, 9 pages.
(Continued)

*Primary Examiner* — David J Walczak
(74) *Attorney, Agent, or Firm* — Sheridan Ross P.C.

(57) ABSTRACT

A container for accommodating a liquid, in particular a deodorant roller, has a container jacket, a discharge opening arranged in the container jacket, a supporting and holding unit which is arranged on the container jacket and which encloses a flow channel connected to the discharge opening, and a ball arranged such that the ball can rotate in the supporting and holding unit and is able to seal off said flow channel with respect to the surroundings of the container is provided herein. Formed between the supporting and holding unit and the ball are at least three contact areas, which run around the ball and are formed substantially parallel to one another. Preferably, at least two contact areas are formed as a supporting and holding areas, and at least one contact area as a sealing area.

14 Claims, 3 Drawing Sheets

(56) References Cited

FOREIGN PATENT DOCUMENTS

Figure 1:
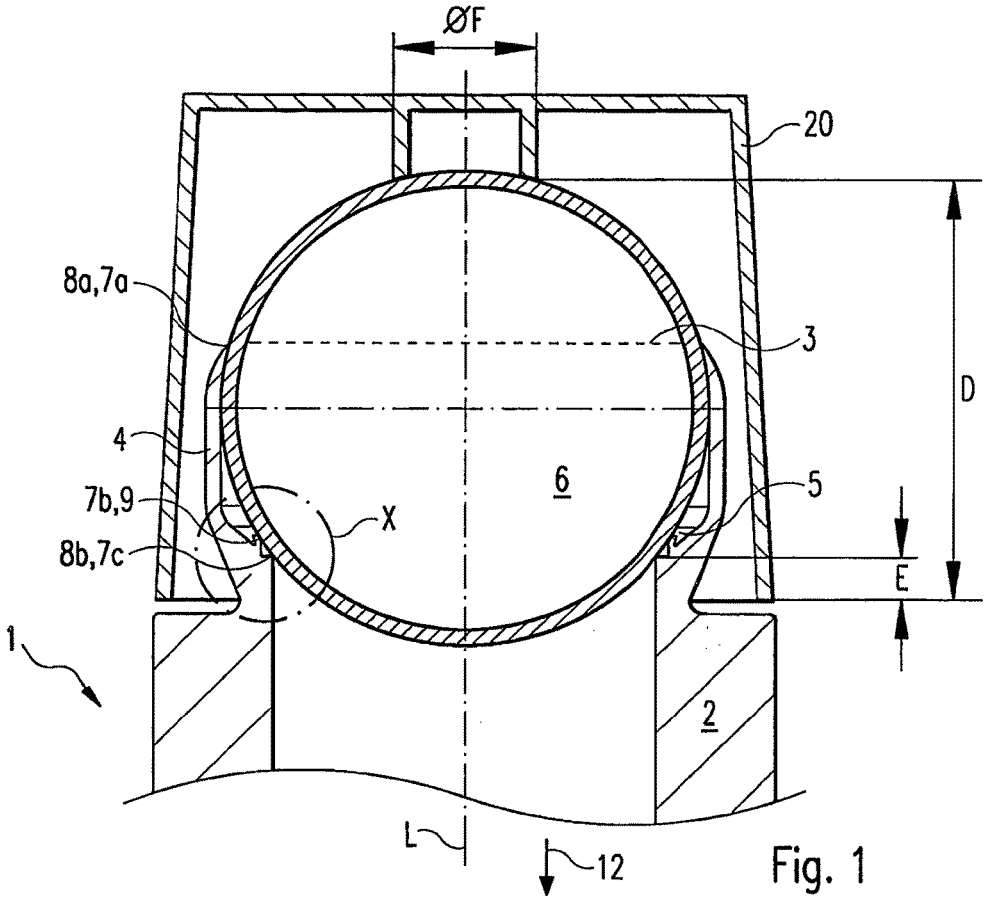

| | | | |
|---|---|---|---|
| GB | 1 166 033 | A | 10/1969 |
| WO | WO 99/30592 | A1 | 6/1999 |
| WO | WO 2009/006713 | A2 | 1/2009 |
| WO | WO 2012/103900 | A1 | 8/2012 |

OTHER PUBLICATIONS

International Search Report and Written Opinion prepared by the European Patent Office dated May 27, 2015, for International Application No. PCT/EP2015/000340.
English Translation of the International Preliminary Report on Patentability for International (PCT) Patent Application No. PCT/EP2015/000340, dated Apr. 6, 2017, 8 pages.

* cited by examiner

CONTAINER FOR ACCOMMODATING A FLOWABLE FLUID

CROSS REFERENCE TO RELATED APPLICATIONS

This application is a national stage application under 35 U.S.C. 371 and claims the benefit of PCT Application No PCT/EP2015/000340 having an international filing date of 16 Feb. 2015, which designated the United States, which PCT application claimed the benefit of German Patent Application No. 20 2014 007 748.7 filed 23 Sep. 2014, the disclosure of each of which are incorporated herein by reference.

The present invention relates to a container for accommodating a flowable fluid comprising a container casing, a discharge opening disposed in the container casing, a supporting and holding unit arranged on the container casing which encloses a flow channel connected to the discharge opening, as well as a ball arranged in the supporting and holding unit.

Such containers are typically used to apply a liquid or a pasty substance onto a surface. Particularly known is the use of such containers as so-called deodorant rollers or roll-on deodorants for applying a deodorizing fluid onto human skin. The present invention will be described in the following using the example of such a deodorant roller but is not, however, to be understood as this being a limiting of the application of the invention.

In order to be able to apply the fluid inside the container onto the skin, the movably held ball needs to be moistened with the fluid. If the deodorant roller is kept in a position in which the ball is situated above the fluid, the deodorant roller must be brought into a position in which the ball is underneath the fluid so that the ball can pick up fluid upon rotating and be able to then dispense it again onto the skin. However, users generally experience it to be more pleasant when the deodorant roller is kept in a position in which the ball is situated beneath the fluid from the very outset. In this case, the ball is already moistened with the fluid and it can be applied faster.

In both configurations, but particularly with the last configuration of the lower-situated ball, care must be taken to ensure that the ball tightly seals the discharge opening of the container in order to prevent the fluid from drying out in the case of the ball situated above and to prevent the fluid from spilling out in the case of the ball situated below.

To be factored in when designing a suitable sealing device, as when designing the deodorant roller as a whole, is that they are normally or only infrequently ever refilled and are thrown away once they become empty. For environmental protection reasons, therefore, using as little material as possible for the container itself needs to be ensured as does ensuring this material also complies with stricter recycling/biodegradability requirements. Of course production and filling costs also play a substantial role.

The task on which the present invention is thus based is that of providing a container of the type cited above which enables the liquid volume to be tightly sealed.

The invention accomplishes this task by way of the subject matter of claim 1. Preferential further developments of the invention constitute the subject matter of the subclaims.

The container according to the invention serves to accommodate a liquid and/or fluid and comprises a container casing. A discharge opening disposed in the container casing serves in dispensing the liquid from the container or interior of the container respectively into its immediate surroundings. A supporting and holding unit is arranged on the container casing which encloses a flow channel connected to the discharge opening. A ball is movably arranged in the supporting and holding unit, its form at least substantially approximating the ideal geometrical shape. The ball substantially closes off this flow channel relative to the container's surrounding area. At least three contact areas are formed between the supporting and holding unit and the ball, these contact areas disposed around the ball and formed substantially parallel to one another.

A first contact area effects the transfer of forces between the ball and the supporting and holding unit (supporting forces) which serve in supporting the ball particularly during the use of the container (supporting function). At least one further contact area (sealing area) serves the sealing (sealing function) between the supporting and holding unit and the ball, substantially not, however, the transmitting of supporting forces. Hence, a wall section of the supporting and holding unit can be formed in the sealing area to abut against the ball and thereby merely elastically deform.

A container casing as defined by the invention is to be understood as a wall of the container which limits a containment chamber of the container relative to the surroundings and can prevent an exchange of substances between the containment chamber and the surroundings. Preferably, the container casing has an at least partly rotationally symmetrical configuration made from a polymer and/or produced by means of injection blow molding, extrusion blow molding or other such similar process.

A discharge opening as defined by the invention is to be understood as an opening in the container casing which serves in the directed dispensing of the liquid accommodated in the containment chamber into the surroundings of the container. Preferably, the discharge opening is arranged perpendicular to a longitudinal axis of the container and/or is of substantially circular form.

A supporting and holding unit as defined by the invention refers to a unit which is arranged on the container casing and serves to support or respectively hold the ball. The ball is supported and held such that it can rotate within the supporting and holding unit. Preferably, the supporting and holding unit is made from the material of the container casing, is materially bonded to the container casing and/or is of integral design with the container casing.

A flow channel as defined by the invention is to be understood as a channel which serves in guiding the liquid held in the containment chamber toward the discharge opening. The flow channel thus extends at least between the containment chamber and the discharge opening. The flow channel is at least partially enclosed by the supporting and holding unit.

A ball within the meaning of the invention is to be understood as a substantially rotationally symmetric body which intermittently serves in supplying the liquid from the containment chamber into the surroundings. Together with the supporting and holding unit, the ball intermittently serves to seal the container or, respectively, the discharge opening or flow channel. Preferably, the ball has a diameter of between 25 and 45 mm or between 20 and 45 mm, particularly preferentially between 22 and 28 mm or between 30 and 38 mm.

A contact area as defined by the invention refers to an area in which the supporting and holding unit can come into mechanical contact with the ball. The term "mechanically contact" also includes the case of a liquid film being present between the contacting elements. During the use and storage of the container, the contact areas can shift along the surface of the ball. Preferably, one of the contact areas is arranged adjacent to the discharge opening.

The following will describe preferential further developments of the container which, unless explicitly excluded, can each be respectively combined with one another.

According to one preferential further development, at least two contact areas are formed as supporting and holding areas and at least one contact area as a sealing area. The supporting and holding areas prevent the ball from exiting out of the supporting and holding unit into the surroundings as well as from migrating in the direction of the containment chamber. Supporting forces can be transferred between the ball and the supporting and holding unit within said supporting and holding area. The sealing area serves in the sealing between the supporting and holding unit and the ball, substantially not, however, in the transmitting of supporting forces. Allocating the supporting function and the sealing function to different contact areas enables being able to better adapt these contact areas to the respective function. It is particularly advantageous for there to be lower sealing forces since there is no need to absorb supporting forces in the sealing area, with lower deforming forces thus resulting. Given that favorable plastic materials tend to set, this thereby enables achieving long-lasting sealing effect also being able to be ensured in the case of economical materials.

According to one preferential further development, the supporting and holding unit can comprise a particularly circumferential shoulder, in particular having a boundary edge, in one of the supporting and holding areas which can serve as the seat of the ball against which the ball can be pressed. Preferably, the shoulder is designed to be of sufficient mechanical stability or rigidity to absorb the supporting forces. This thereby improves the sealing.

According to one preferential further development, at least two contact areas are designed as supporting and holding areas and at least two contact areas are designed as sealing areas. A contact area adjacent to the discharge opening thereby serves both as a supporting and holding area as well as a sealing area and thus provides the supporting function as well as the sealing function. A supporting and holding area as well as a sealing area spatially separated from said supporting and holding area is arranged at the opposite end of the supporting and holding unit from the discharge opening. This separation enables dissociating the sealing area from the supporting function. Additionally, the separate supporting and holding area can better absorb the forces pressing the ball toward the containment chamber when the container is being used.

According to one preferential further development, at least one of the contact areas, in particular one of the sealing areas, is configured with at least one projection arranged circumferentially in the supporting and holding unit and upon which the ball rests in at least one of the two possible vertical positions.

According to one preferential further development, the at least one projection is designed with a circumferential boundary edge. This boundary edge serves in mechanically contacting the ball along a circular curve.

According to one preferential further development, the at least one projection is materially bonded to or integrally formed with a wall of the supporting and holding unit. This can thereby reduce manufacturing costs.

The supporting and holding unit can however also be of multi-part design, wherein at least one contact area or its projection is preferably designed as an insert.

According to one preferential further development, a substantially hollow cylindrical first section of the at least one projection extends parallel to a longitudinal axis extending through the supporting and holding unit.

According to one preferential further development, a second section of the at least one projection is elastically deformable and/or elastically expandable, particularly by the ball. The second section can thereby be elastically; i.e. reversibly, transformed from its non-deformed state into its deformed state. Because of the merely elastic deformation and/or expansion, the second section can be substantially completely restored. Preferably, the second section is integrally formed with the first section of the projection. Doing so can thereby increase the restorability of the projection. Preferably, the projection is made from polypropylene or polyethylene. Particularly preferentially, the entire container and supporting and holding unit is integrally formed from polypropylene or polyethylene. However, other plastics are also conceivable hereto.

According to one preferential further development, at least one of the sealing areas is spaced at a predetermined distance C from one of the supporting and holding areas along a longitudinal axis L extending through the supporting and holding unit. Preferably, the distance amounts to more than 1 mm. Preferably, the distance between a boundary edge of at least one projection of one of the sealing areas and a boundary edge of one of the supporting and holding areas along a longitudinal axis L extending through the supporting and holding unit is greater than 1 mm.

According to one preferential further development, the container comprises a cap able to be detachably connected to the container casing or to the supporting and holding unit. The ball can thereby be pressed against a shoulder or projection of the supporting and holding unit. This can thereby improve the sealing.

Figure 3:
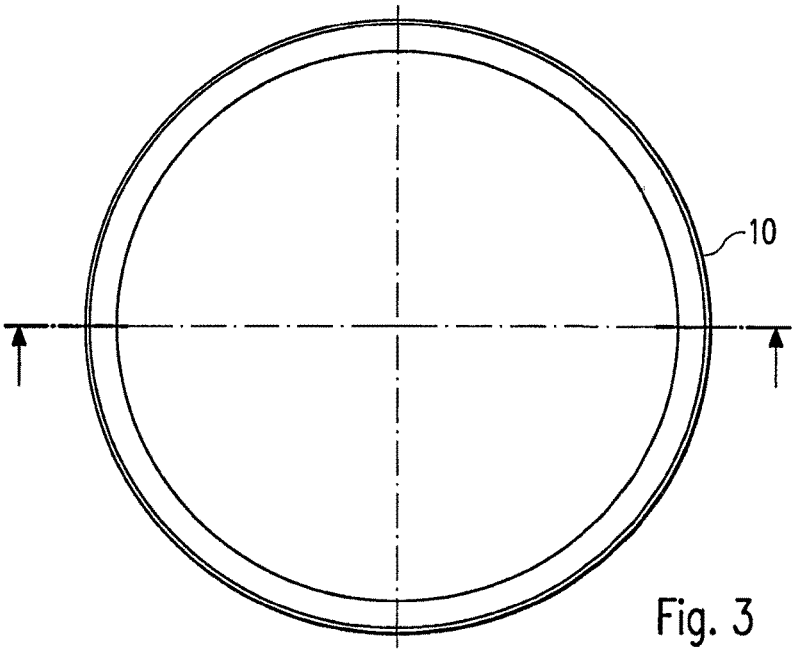
Figure 2A:
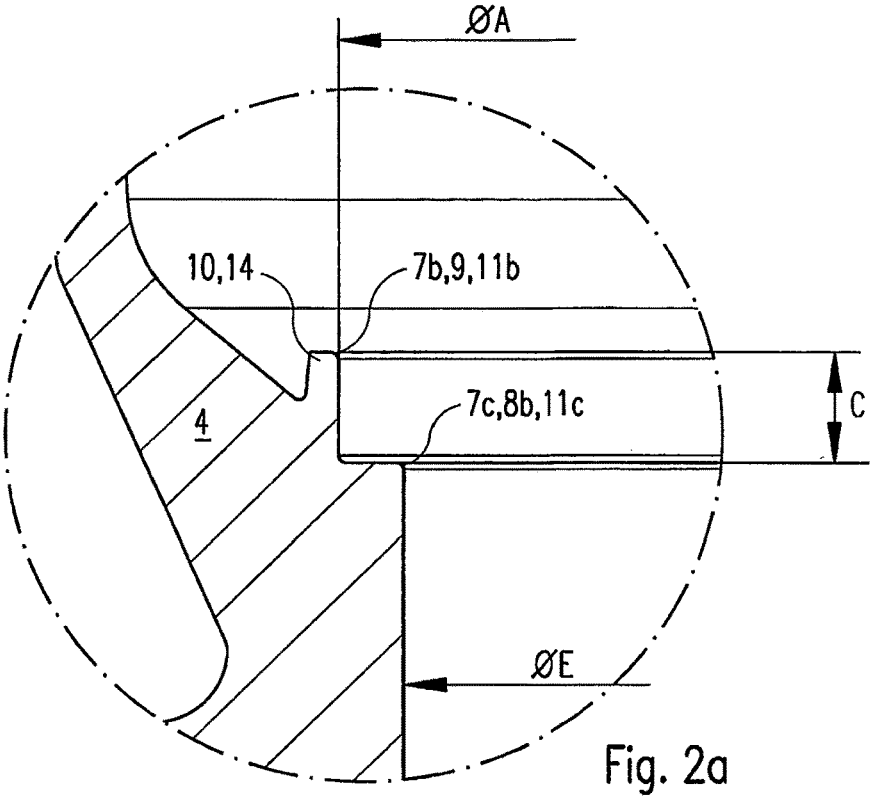
Figure 2B:
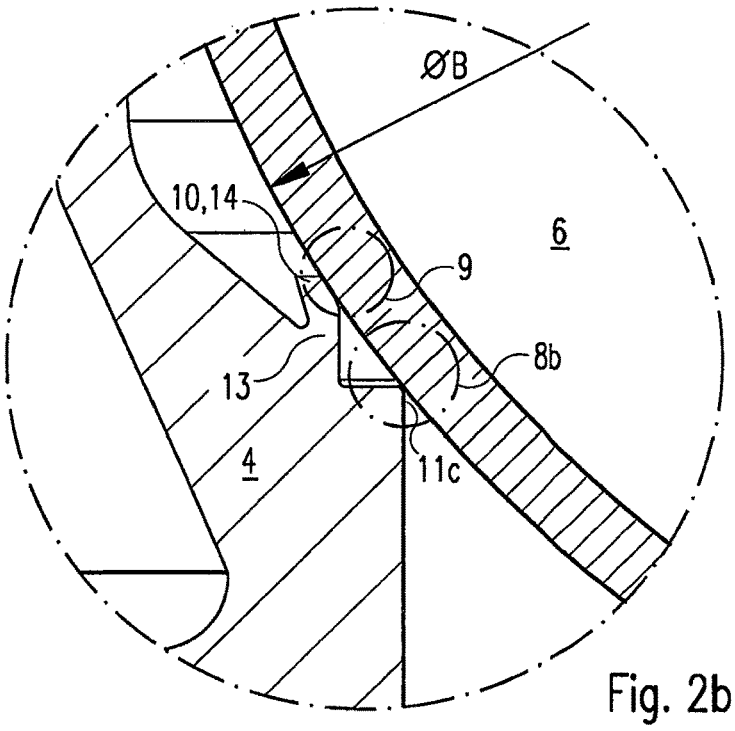
Figure 4A:
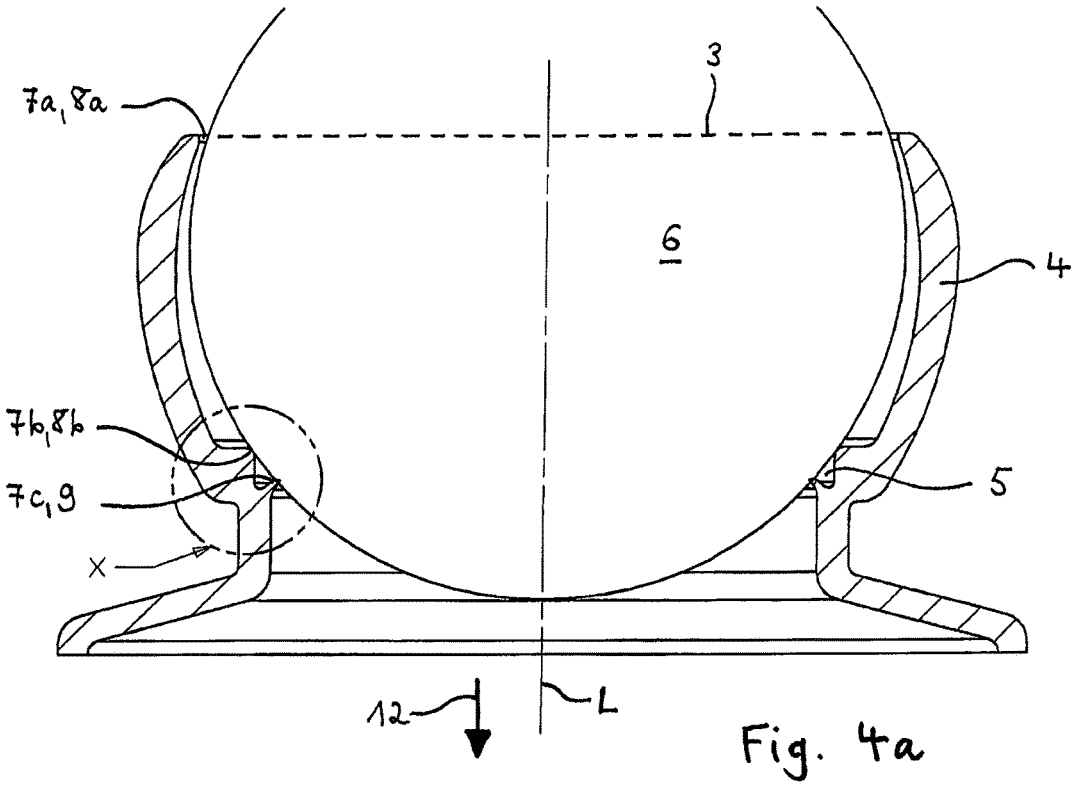
Figure 4B:
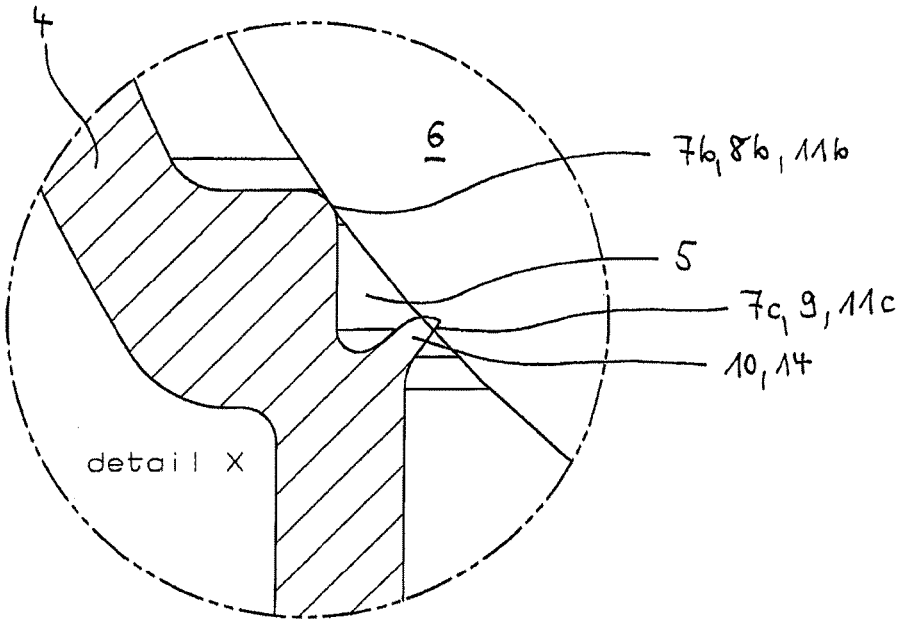

Further advantages, features and possible applications of the present invention will follow from the description below in conjunction with the figures. Shown are:

FIG. 1 a sectional view through a first preferential further development of the container, FIGS. 2*a* and 2*b* a detail from the FIG. 1 container, FIG. 3 another view of the FIG. 2*a* detail, FIG. 4*a* a sectional view through a second preferential further development of the container, and FIG. 4*b* a detail from the FIG. 4*a* container.

FIG. 1 shows a sectional view through a first preferential configuration of the upper part of an example embodiment configured as a deodorant roller.

The container 1 for accommodating a fluid comprises the container casing 2, a discharge opening 3 disposed in the container casing 2, a supporting and holding unit 4 arranged on the container casing 2 which encloses a flow channel 5 connected to a discharge opening 3 (indicated by a horizontal dashed line), a ball 6 arranged in the supporting and holding unit 4 which can close off the flow channel 5 vis-à-vis the surrounding area of the container 1, as well as three contact areas 7*a*, 7*b*, 7*c* between the supporting and holding unit 4 and the ball 6.

The container 1 additionally comprises a cap 20 which is detachably connected to the container casing 2 and presses the ball 6 along the longitudinal axis L running through the supporting and holding unit 4 toward the not shown, albeit indicated by an arrow and reference numeral 12, containment chamber of the container 1, thus downward in the present depiction. This can thereby improve the sealing of the container 1 when not in use.

The contact area 7*a* arranged above the center point of the ball 6, hereinafter referred to as the first contact area 7*a*, is designed as supporting and holding area 8*a*. In one particular configuration, which FIG. 1 does not depict, the first contact area 7*a* also serves as a sealing area. The second contact area 7*b* and the third contact area 7*c* are spaced apart from one another relative to the longitudinal axis L depicted vertically in the figure below the center point of the ball 6. The second contact area 7*b* serves as sealing area 9 and the third contact area 7*c* as supporting and holding area 8*b*. The supporting and holding areas 8*a*, 8*b* support the ball 6 against the force of gravity and against the contact force when the deodorant fluid is being applied and the force from the screwed-on cap.

The supporting and holding unit 4 comprises a sleeve, its upper end extending upward beyond the center point of the ball 6 to the first contact area 7*a*.

FIG. 1 indicates that the supporting and holding unit 4 comprises a circumferential projection 10 within the second contact area 7*b*, or sealing area 9 respectively, which extends substantially parallel to the longitudinal axis L.

FIGS. 2*a* and 2*b* show a detail from the FIG. 1 container as marked by an X in FIG. 1. Shown specifically is a sectional view through the supporting and holding unit 4 as well as two contact areas 7*b*, 7*c*. The second contact area 7*b* is designed as sealing area 9 and the third contact area 7*c* as supporting and holding area 8*b*.

The supporting and holding unit 4 exhibits a projection 10 in sealing area 9 which extends substantially parallel to the longitudinal axis L. The projection 10 exhibits boundary edge 11*b*. In comparison to the C dimension, by which the projection 10 extends parallel to the longitudinal axis L, the wall thickness of the projection 10 is small in cross section, the projection 10 thus thin. The thin shape enables easier deformation of the projection 10 by the ball 6, in particular elastically and virtually completely reversibly. This can thereby minimize mechanical stresses in the projection 10 as a result of deformation and/or bending, in particular by the ball 6. A more advantageous material, in particular a polymer such as polypropylene or polyethylene, can thereby also be used for the projection 10.

The supporting and holding unit 4 in the supporting and holding area 8*b* is configured with a boundary edge 11*c*, a substantially right-angled shoulder and an annular surface which is arranged substantially perpendicular to the longitudinal axis L through the supporting and holding unit 4. This rather sizable design to the wall of the supporting and holding unit 4 in the supporting and holding area 8*b* compared to the projection 10 enables the improved transfer of supporting forces or support of the ball 6 respectively.

Allocating the supporting function and the sealing function to different contact areas 7*a*, 7*b*, 7*c* enables being able to better adapt their configuration to the respective function.

In FIG. 2*a*, the ball 6 is not depicted and the projection 10 is not deformed. In FIG. 2*b*, on the other hand, the ball 6 lies on the boundary edge 11*c* and the second section 14 of the projection 10 is elastically deformed and/or elastically expanded (deformed state). The second section 14 abuts against the ball 6, thereby improving the sealing.

FIG. 3 shows another view of the FIG. 2*a* detail and depicts the annular surface of the shoulder in the wall of the supporting and holding unit in the region of supporting and holding area 8*b*.

FIG. 4*a* shows a sectional view through a second preferential configuration of the upper part of an example embodiment designed as a deodorant roller. Relative to the container of FIGS. 1 and 2, the supporting and holding area 8*b* and the sealing area 9 are in reversed order of arrangement along the longitudinal axis L therein. In this configuration, the second contact area 7*b* situated closer to the discharge opening 3 therefore serves as the supporting and holding area 8*b* and the third contact area 7*c* farther from the discharge opening 3 serves as the sealing area 9.

The first contact area 7*a* is further designed as supporting and holding area 8*a* and comprises in the configuration according to FIG. 4*a* a radially inward positioned supporting ring of very low axial expansion. A very small contact surface between the supporting and holding unit 4 and the ball 6 thereby results.

FIG. 4*b* shows a detail from the FIG. 4*a* container as marked by an X in FIG. 4*a*. Therein—as also in FIG. 4*a*—the depiction shows the sealing area 9 as non-deformed and thus the ball 6 in traversing state.

Since in the cross-sectional view depicted in FIG. 4*b*, the tangent of the ball 6 at contact area 7*c* and thus at sealing area 9 encloses a larger angle with longitudinal axis L than at contact area 7*b* (at which the sealing area is arranged in the configuration according to FIG. 1), the form of the projection 10 in the sealing area 9 also differs compared to that in FIG. 1. The projection 10 substantially projects inwardly in the radial direction of the ball from the supporting and holding unit 4, tapering inward to its boundary edge 11*c*. When the ball 6 seats on the boundary edge 11*c*, the second section 14 of the projection 10 is thus elastically deformed. The contact surface of boundary edge 11*c* is thereby substantially formed by the rounded side of the second section 14 of the projection 10.

Preference is for instance given to the following dimensions and materials:

- Material: polypropylene or polyethylene for container and supporting device
- ball diameter of from 25 to 45 mm or 20 to 45 mm, particularly preferentially 22 to 28 mm or 30 to 38 mm
- projection height (dimension C in FIG. 2*a*) of 0.5 to 3 mm, preferentially 0.5 to 2.5 mm, particularly preferentially 0.5 to 2 mm, further preferentially 0.8 to 2 mm, even further preferentially 1 to 2 mm
- projection wall thickness 0.1 to 0.5 mm

LIST OF REFERENCE NUMERALS

1 container
2 container casing
3 discharge opening
4 supporting and holding unit
5 flow channel
6 ball
7*a* first contact area
7*b* second contact area
7*c* third contact area
8*a*, 8*b* supporting and holding area
9 sealing area
10 projection
11*b*, 11*c* boundary edges
12 containment chamber
13 first projection section
14 second projection section
20 cap
L longitudinal axis
C distance between two boundary edges or projection height respectively

The invention claimed is:

1. A container for accommodating a flowable fluid, comprising:

a container casing, a discharge opening disposed in the container casing, a supporting and holding unit arranged on the container casing which encloses a flow channel connected to the discharge opening, a ball movably arranged in the supporting and holding unit, its form at least substantially approximating an ideal geometrical shape and which can close off said flow channel relative to an area surrounding the container, wherein at least three contact areas are formed between the supporting and holding unit and the ball, and the at least three contact areas are disposed around the ball and formed substantially parallel to one another, wherein at least one of the contact areas is formed with at least one projection arranged circumferentially in the supporting and holding unit and upon which the ball rests in at least one of two possible vertical positions of the container, and wherein the at least one projection extends upward from the supporting and holding unit and extends substantially parallel to a longitudinal axis extending through the supporting and holding unit.

2. The container according to claim 1, wherein at least two of said contact areas are formed as supporting and holding areas and at least one contact area as a sealing area.

3. The container according to claim 1, wherein at least two contact areas are formed as supporting and holding areas and at least two contact areas as sealing areas.

4. The container according to claim 3, wherein one of the sealing areas is arranged between two further of said contacts areas along a longitudinal axis extending through the supporting and holding unit.

5. The container according to claim 3, wherein at least one of the sealing areas is spaced at a predetermined distance from one of the supporting and holding areas along the longitudinal axis extending through the supporting and holding unit.

6. The container according to claim 1, wherein the at least one projection has a circumferential boundary edge.

7. The container according to claim 1, wherein the at least one projection is integrally formed with the supporting and holding unit.

8. The container according to claim 1, wherein a substantially hollow cylindrical first section of the at least one projection extends parallel to the longitudinal axis extending through the supporting and holding unit.

9. The container according to claim 8, wherein a second section of the at least one projection is elastically deformable and/or elastically expandable.

10. The container according to claim 3, wherein the at least one projection is arranged within one of the sealing areas and can abut against the ball at least in sections.

11. The container according to claim 1, further comprising a cap detachably connected to the container casing able to press the ball away from the discharge opening.

12. The container according to claim 1, wherein a height of the at least one projection is between 1 and 2 mm.

13. The container according claim 12, wherein a wall thickness of the at least one projection is between 0.1 and 0.5 mm.

14. A container for accommodating a flowable fluid, comprising:

a container casing, a discharge opening disposed in the container casing, a supporting and holding unit arranged on the container casing which encloses a flow channel connected to the discharge opening, a ball movably arranged in the supporting and holding unit, its form at least substantially approximating an ideal geometrical shape and which can close off said flow channel relative to an area surrounding the container, wherein at least three contact areas are formed between the supporting and holding unit and the ball which are disposed around the ball and formed substantially parallel to one another, wherein at least two contact areas are formed as supporting and holding areas and at least one contact area as a sealing area, wherein at least one of the sealing areas is formed with at least one projection arranged circumferentially in the supporting and holding unit and upon which the ball rests in at least one of two possible vertical positions of the container, wherein at least one of the sealing areas is spaced at a predetermined distance from one of the supporting and holding areas along a longitudinal axis extending through the supporting and holding unit, and wherein a height of the at least one projection is between 1 and 2 mm.

* * * * *